United States Patent [19]

Sjölander

[11] 4,082,565

[45] Apr. 4, 1978

[54] METHOD AND APPARATUS FOR THE REMOVAL OF DEPOSITS FROM A FUEL INJECTION VALVE

[76] Inventor: Rino Sjölander, Slanbarsvagen 5, 442 00 Kungalv, Sweden

[21] Appl. No.: 749,619

[22] Filed: Dec. 9, 1976

[30] Foreign Application Priority Data

Dec. 15, 1975 Sweden ..... 7514128

[51] Int. Cl.[2] ..... B08B 3/12

[52] U.S. Cl. ..... 134/1; 134/23; 134/25 A; 134/116; 134/169 A; 134/184; 239/112; 239/585

[58] Field of Search ..... 134/1, 22 R, 23, 39, 134/116, 166 R, 167 R, 184, 22 C, 18, 25 A, 169 A; 137/15; 239/112, 585

[56] References Cited

U.S. PATENT DOCUMENTS

| | | | |
|---|---|---|---|
| 2,814,575 | 11/1957 | Lange | 134/23 X |
| 2,974,070 | 3/1961 | Dongeren | 134/23 X |
| 3,234,047 | 2/1966 | Olson | 134/39 X |
| 3,442,705 | 5/1969 | Wheatley | 134/1 |
| 3,638,666 | 2/1972 | Fishman | 134/1 X |

FOREIGN PATENT DOCUMENTS

| | | | |
|---|---|---|---|
| 429,856 | 2/1972 | U.S.S.R. | 134/1 |

*Primary Examiner*—S. Leon Bashore
*Assistant Examiner*—Marc L. Caroff

[57] ABSTRACT

A method for the removal of deposits from a fuel injection valve of the type containing a reciprocatory sprayer needle unit including a valve member and a solenoid for operating the sprayer needle unit, in which at least a front portion of the valve is immersed in a pool of liquid detergent, and the pool is subjected to ultrasonic vibrations while maintaining a current of a liquid detergent through the valve and maintaining a reciprocatory motion of the sprayer needle unit by supplying a periodic electric current to the solenoid of the valve.

6 Claims, 5 Drawing Figures

37
28
32b
32a
1
13b
13a
12
11
4
54
10
2
3
III
III

METHOD AND APPARATUS FOR THE REMOVAL OF DEPOSITS FROM A FUEL INJECTION VALVE

This invention relates to a method for the removal of deposits from a fuel injection valve of a gasoline motor.

Fuel injection valves are used in various fuel injection systems developed in order to provide a more accurate metering of the quantity of fuel supplied to each of the cylinders of the motor during the suction stroke and a better control of the fuel/air weight relation. In operation, the fuel injection valves, particularly their front portion, are apt gradually to acquire an outer and inner deposit restricting the area of the fuel passage of the injection valve. The resulting modification of the function of the injector valve is particularly harmful for the type of injector valves which contain a reciprocatory sprayer needle unit and a solenoid for operating the same, as in that case the fuel flow through the valve will vary very strongly with the area of the fuel passage. Hitherto, no satisfactory method for the removal of the deposits has been available. Car owners simply had to replace the injection valves by a new set when the valves did not longer work properly. This is an expensive step which is frequently put off until serious motor trouble appears. The motor then has had to work for a long time with a wrong proportion of fuel to air, resulting in a loss of motor power and efficiency.

The invention has for its principal object to provide a satisfactory method for the removal of deposits from a fuel injection valve for a gasoline motor.

The method according to the invention comprises the steps of removing the valve from the motor, immersing at least a front portion of the valve in a pool of liquid detergent, and subjecting said pool to ultrasonic vibrations while maintaining a current of the liquid detergent through the valve. In cleaning a valve of the type comprising a reciprocatory sprayer needle unit and a solenoid for operating the same, the above steps are preferably supplemented by the additional step of maintaining a reciprocatory motion of the sprayer needle unit by supplying a periodic electric current to the solenoid of the valve.

The invention also includes apparatus for carrying out the method of the invention, comprising a container, a pool of detergent in said container, a supporting means arranged to maintain a plurality of injection valves in a vertical position in which at least their front portions are immersed in said pool, at least one ultrasonic vibrator arranged to submit said pool to ultrasonic vibrations, means for energizing said ultrasonic vibrator, and means for causing a current of the detergent to flow through each of the injection valves.

Figure 1:
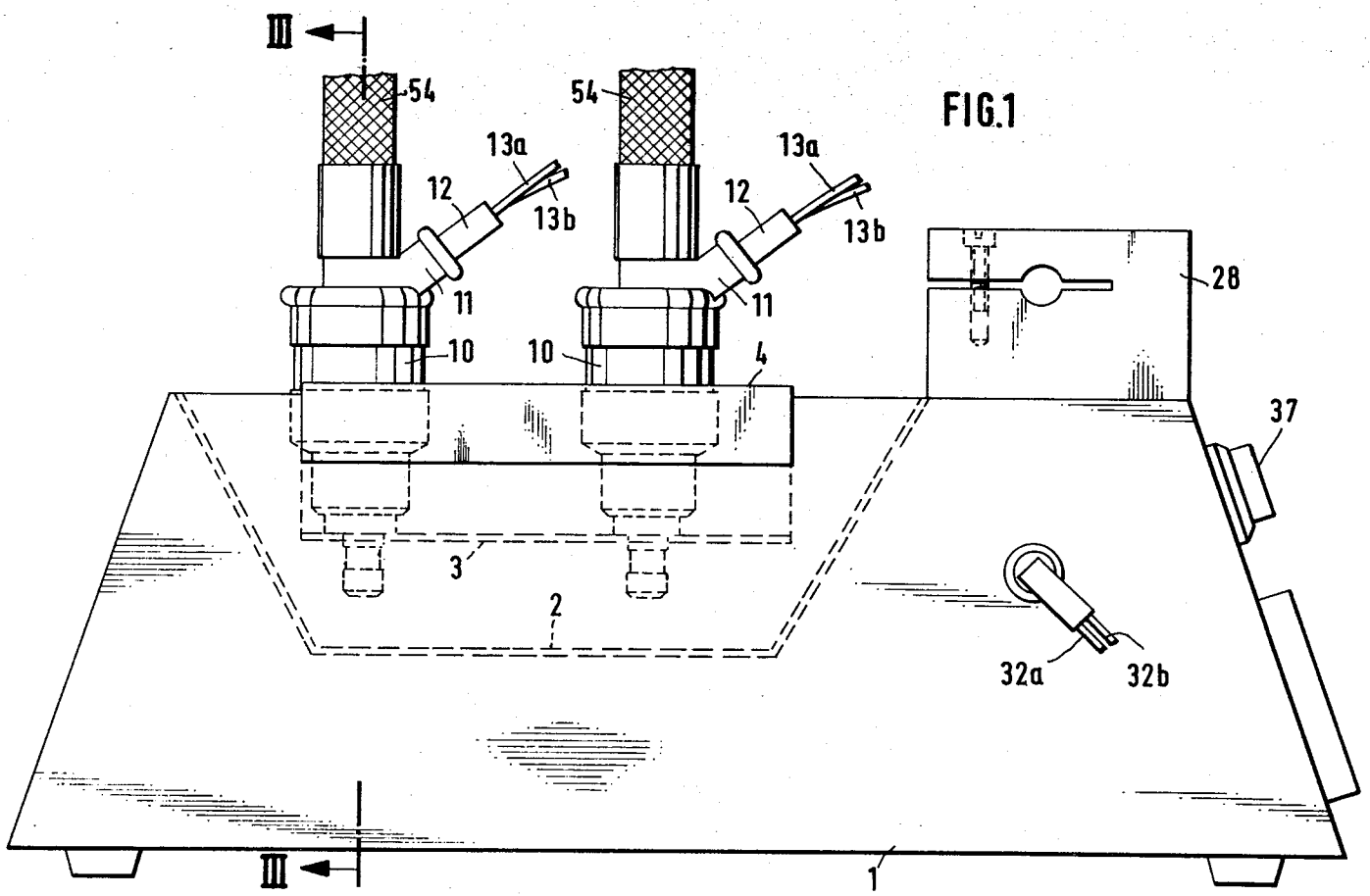
Figure 2:
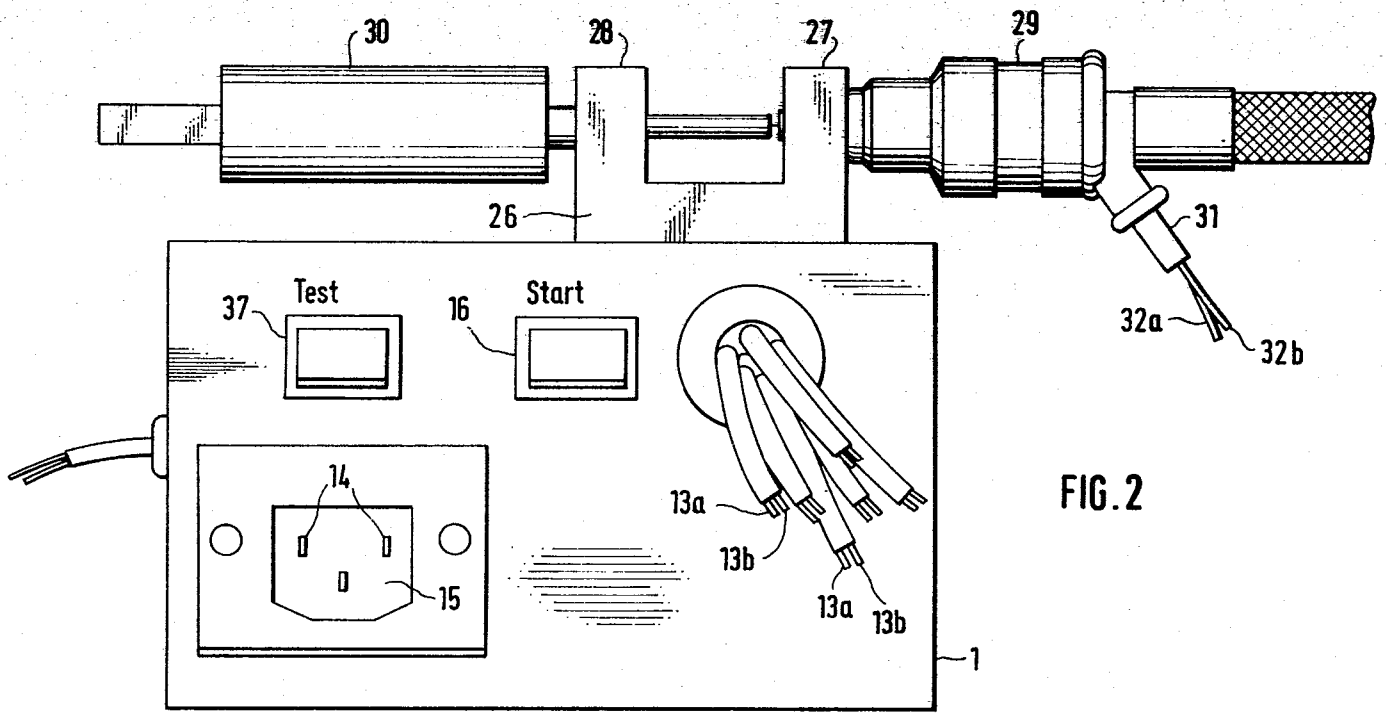
Figure 3:
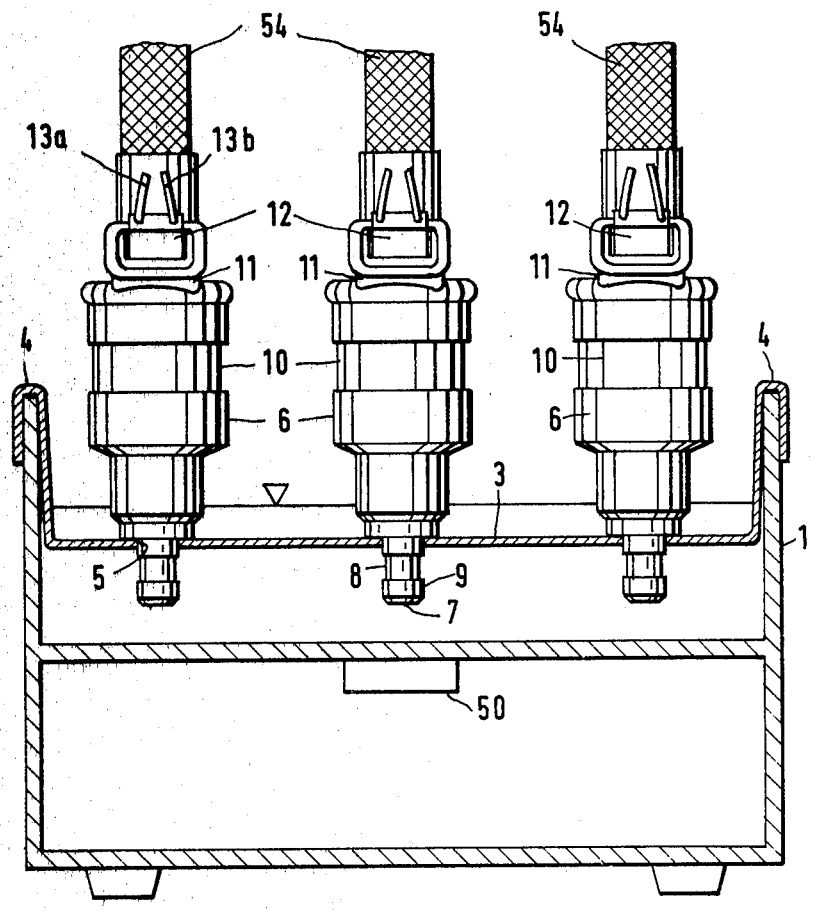
Figure 4:
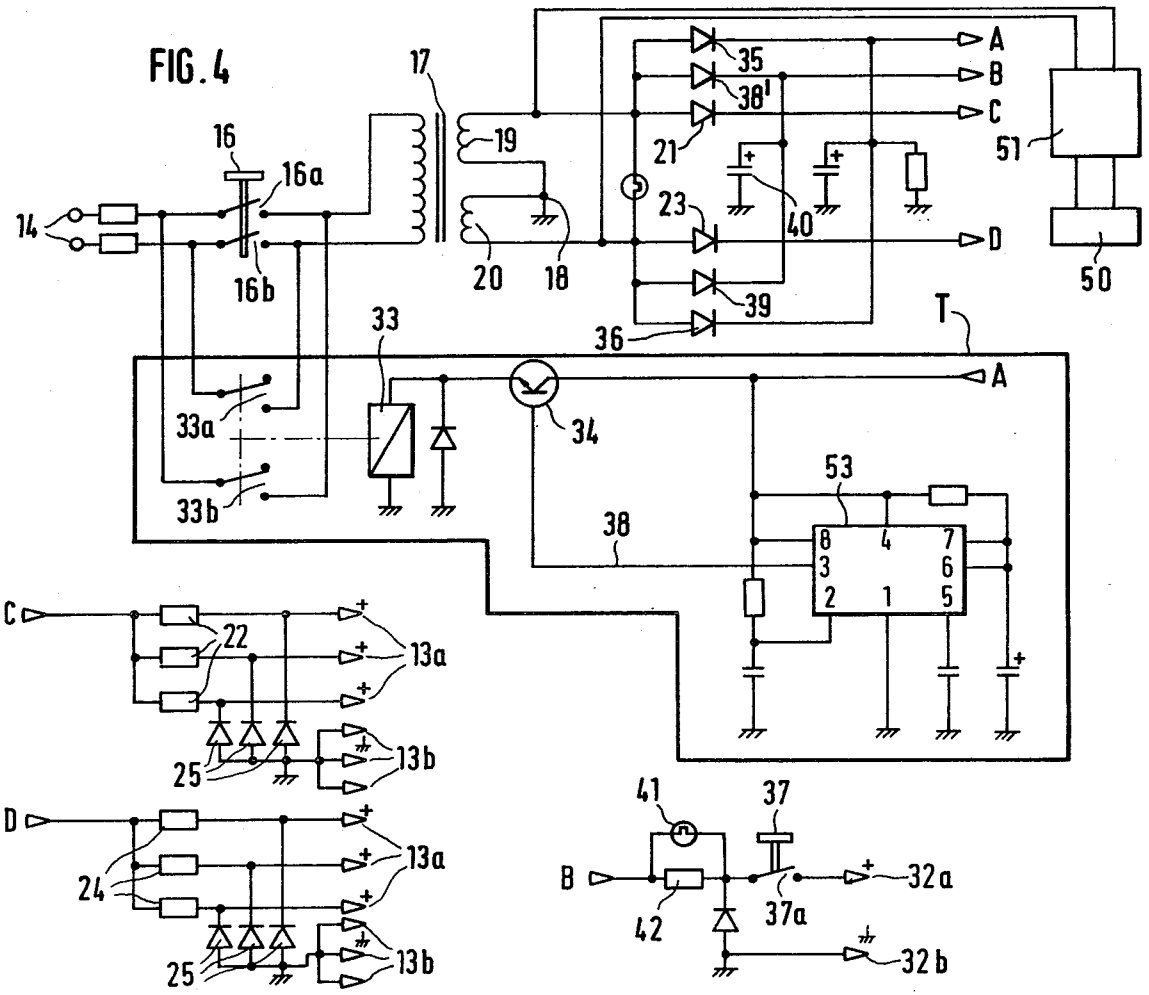
Figure 5:
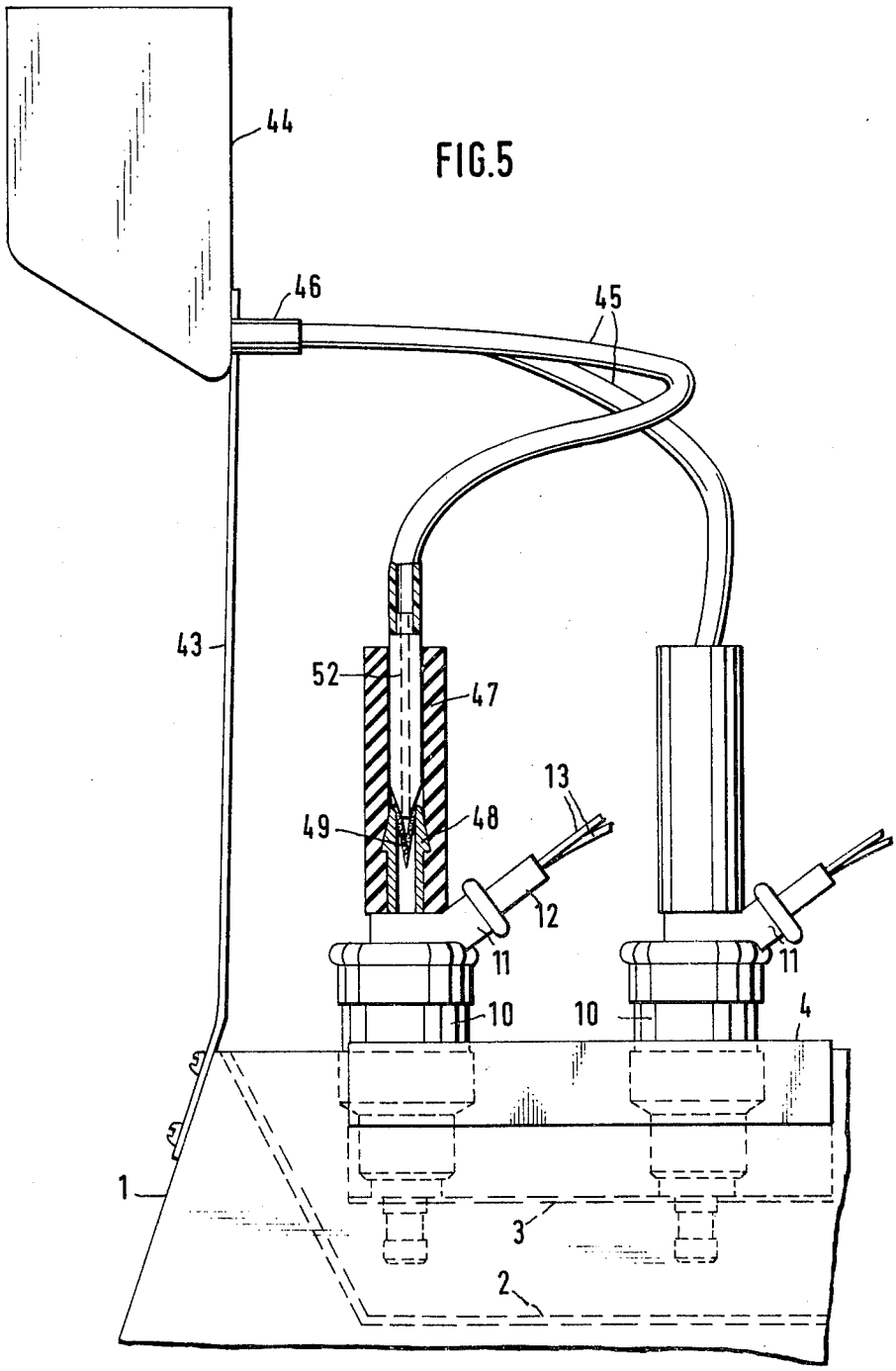

Other objects and features of the invention will appear from the following description of embodiments of the invention with reference to the appended drawings, in which FIG. 1 shows a cleaner unit according to the invention in side elevational view, FIG. 2 shows the unit seen from the right in FIG. 1, with some added details, FIG. 3 is a cross-sectional view taken on the line III—III in FIG. 1, FIG. 4 is a circuit diagram for the electric circuits of the unit, and, FIG. 5 is a partial elevational view similar to FIG. 1 of the unit supplemented with a gravity tank.

The unit shown comprises a housing 1 the roof of which includes a channel shaped part 2 extending between the flat side walls of the housing and forming the bottom of an open container containing a pool of a suitable liquid detergent. A supporting plate 3 is suspended in the container by its hook-shaped end portions 4 resting on the lateral edges of the container. The supporting plate is provided with six holes 5 to accommodate six injection valves 6. These injection valves are of the known type comprising a sprayer needle unit coaxially reciprocable in guide means in the valve housing. The sprayer needle is provided at its front extremity with a sprayer pin 7 (FIG. 3), which projects out of a central hole in a cap 9 attached to the cylindrical front portion 8 of the housing of the valve 6. Said cap 9 is provided at its inside with a valve seat cooperating with a portion of the sprayer needle serving as a valve member. The rear end of the sprayer needle is connected to an iron core arranged to be magnetised by a solenoid enclosed in a casing 10. The solenoid is wired to a jack 11 mating with a plug 12 connected by conductors 13*a, b* to a source of current provided in the housing 1. A helical spring acting upon the sprayer needle tends to maintain the sprayer needle in its foremost position, in which the valve is closed. When a current is supplied to the solenoid, the sprayer needle is retracted a short distance (for example 0.15 mm), whereby the valve is opened.

A U-shaped part 26 is mounted on the top of the housing 1 beside the container formed by the part 2. The shanks 27, 28 of said part 26 each constitute a holder means for an injection valve 29 and a dial indicator 30, respectively (FIG. 2), to permit checking of the stroke of the sprayer needle of the injection valve. The solenoid of the injection valve 29 is electrically connected with the current supply system by means of a plug 31 and a pair of conductors 32*a, b*.

The current supply system provided in the housing is arranged to be connected to the alternating current mains by a pair of connecting members 14 of a connector 15 (FIG. 2). The contacts 14 are connected to the primary terminals of a mains transformer 17 through circuit means including a pair of spring activated make contacts operated by a push button 16. A centre tap 18 divides the secondary winding of said transformer into two halves 19, 20. The points of the circuit marked with an earth symbol are connected with said centre tap 18. The live terminal of the secondary winding half 19 is connected through a diode 21 to the common terminal of three resistors 22 each of which is connected in series with a conductor 13*a*. The secondary winding half 20 is connected through a diode 23 to the common terminal of three resistors 24 each of which is connected in series with one of three other conductors 13*a*. The six conductors 13*b* are connected to the centre tap 18. The circuit described will supply from 25 to 100 pulses per second, and preferably 50 half-wave pulses per second to each of the pair of conductors 13*a*, 13*b* and, consequently, to each of the solenoid windings connected to said conductors. To provide ratio noise elimination, each of the pairs of conductors 13*a*, 13*b* is shunted by a diode 25.

A relay 33 in series with a transistor 34 receives a full-wave rectified voltage, one half-wave of which is supplied by the winding 19 via a diode 35, and the other half-wave of which is supplied by the winding 20 via a diode 36. This relay operates on operation of the push button switch 16 and closes its make contacts 33*a, b* connected in parallel with the make contacts of the push button switch. Thus, the transformer 17 remains connected to the mains when the push button switch springs back to the normal position. The full-wave rectified voltage above referred to also energizes a timer 53. Said timer 53 is arranged a predetermined time after the application of the energizing voltage to impress a blocking voltage on the base of the transistor 34 via a conductor 38. This timer can be of any type available in the market, for example Motorola 1455 P, and requires no detailed description. When the transistor 34 is blocked, the relay 33 is deenergized and drops off, causing its make contacts 33*a, b* to disconnect the transformer 17 from the mains.

The relay 33, the timer 53 and the other circuit elements comprised within the frame line "T" constitute a time unit or time switch T.

The secondary winding 19–20 also serves to supply an oscillator 51 generating an ultrasonic frequency (approx. 50 kHz). The output voltage of said oscillator is supplied to a piezoelectric ultrasonic transmitter mechanically attached to the underside of the bottom 2 of the receptacle. The ultrasonic vibrations thus transmitted into the cleaning bath strongly assist the cleaning action of the detergent. Instead of the single transmitter shown, a plurality of transmitters may be distributed about the container in such a way that the front portions of all of the injection valves are subjected to approximately equal intensities of the ultrasonic radiation.

The container is filled with the liquid detergent up to a suitable level, for instance the level indicated by a triangle mark in FIG. 3. The solenoids of the valves 10 are connected to the current supply system by means of the plugs 12, and the narrow front portions 8 of the valves are inserted into the holes 5 of the supporting plate 3. The rear orifices of the valves are connected by flexible conduits 54 to a suitable source of detergent causing a slow stream of detergent to flow through the valves. The operator starts the cleaning process by depressing for a moment the push button 16. The circuits above described are thereby rendered active to cause the sprayer needles to reciprocate with a frequency of 50 double strokes per second and to cause the transmitter 50 to vibrate with an ultrasonic frequency. Both of said actions continue during a period determined by the timer 53. Said period is chosen so as to result in a complete removal of the deposits. As a rule, a period of 1 to 2 minutes will be sufficient. Particularly thick or hard or otherwise refractory deposits may require somewhat longer time, for instance 5 minutes.

After the cleaning operation, it is advisable to check the length of stroke of the sprayer needles of the injection valves. For this purpose the valve 29 (FIG. 2) is clamped in the holder 27 in front of the dial indicator 30 clamped in the holder 28 so as to cause the tip of the sprayer needle of the valve to engage lightly the sensing tip of the indicator. The operator then makes the sprayer needle perform a backwards stroke by depressing a push button 37 mounted on the housing 1. The make contact 37*a* of this push button thereby closes a circuit through the pair of conductors 32*a*, 32*b* and the solenoid of the valve 29, said circuit being supplied with a full-wave rectified voltage one half-wave of which is supplied by the winding 19 through the diode 38 the other half-wave of which is supplied by the winding 20 through the diode 39. A capacitor 40 bridging this feed circuit provides a smoothing action sufficient to ensure that the sprayer needle at the conclusion of its backward stroke remains in its rear position without vibrations. An indicator lamp 41 bridging a resistor 42 connected in series with the push button contact 37*a* indicates that a current is flowing in the circuit. The length of stroke of the sprayer needle is the difference between the readings of the dial indicator before and during depression of the push button 37.

In FIG. 5, the reference numerals 1–4 and 10–13 denote the same parts as in the FIGS. 1–3. In the embodiment according to FIG. 5 a second container 44 for the liquid detergent is mounted on the receptacle 1 by means of a standard 43. Said second container is provided with six bottom outlets 46 each of which is connected to an injection valve 10 by a flexible conduit 45. The outlet end of the house is fitted with a tubular nylon plug 52, which is inserted in a rubber bushing 47 engaging the inlet nipple 48 of the injection valve. A conical filter 49 of fine-mesh metal gauze is clamped between the tapering lower extremity of the nylon plug 52 and the upper edge of the nipple 48.

Before the treatment is started, liquid detergent is poured into the container 44 as well as into the container 1. The gravity acting on the liquid in the container 44 causes a slow stream of liquid to flow from said container through the valves. This stream carries away the particles detached from deposit during the cleaning process (as well as dissolved impurities). After the treatment, the interior of the valves is, therefore, completely free not only from adhering deposit but also from loose particles.

The composition of the liquid detergent to be employed in the method according to the invention is not critical. It is, for instance, possible to use an aqeous solution of caustic potash or caustic soda. Preferably, however, detergents consisting of an organic solvent or mixtures of organic solvents are used. Satisfactory results have been obtained with various so-called carburetter cleaning liquids available in the market as well as with various liquids marketed as paint diluents. Before adopting a certain detergent in the method according to the invention, it is advisable to perform preliminary tests to make sure that the detergent has no harmful action on the valves or on any part of the cleaning apparatus.

I claim:

1. A method for the removal of deposits from a fuel injection valve of the type containing a reciprocatory sprayer needle unit and a solenoid for operating said sprayer needle unit, said sprayer needle unit including a valve member, comprising the steps of immersing at least a front portion of the valve in a pool of liquid detergent, and subjecting said pool to ultrasonic vibrations while maintaining a current of a liquid detergent through the valve and maintaining a reciprocatory motion of the sprayer needle unit by supplying a periodic electric current to the solenoid of the valve.

2. Apparatus for the removal of deposits from a fuel injection valve of the type containing a reciprocatory sprayer needle unit and a solenoid for operating said sprayer needle unit, said sprayer needle unit including a valve member, said apparatus comprising a container, a pool of detergent in said container, supporting means arranged to maintain a plurality of injection valves in a vertical position in which at least their front portions are immersed in said pool, at least one ultrasonic vibrator arranged to submit said pool to ultrasonic vibrations, means for energizing said ultrasonic vibrator, means for generating electric pulses having a frequency in the range from 25 to 100 pulses per second, circuit means for transmitting said pulses to each of the solenoids of said injection valves, and means for causing a current of the detergent to flow through each of said injection valves.

3. Apparatus as claimed in claim 2, which comprises a second container mechanically connected to said container by supporting means arranged to maintain the bottom of said second container above the upper rim of said container, a plurality of outlets provided at the bottom of said second container, and flexible conduits for connecting each of said outlets to one of said injection valves.

4. Apparatus as claimed in claim 2, which includes a time switch arranged to stop the energizing of said ultrasonic vibrator at the end of a predetermined period.

5. Apparatus as claimed in claim 2, which includes a time switch arranged to stop the supply of electric pulses to the solenoids at the end of a predetermined period.

6. Apparatus as claimed in claim 2, which comprises a housing enclosing the means for energizing the ultrasonic vibrator as well as the means for producing electric pulses, said container constituting part of the wall of said housing, an injection valve holder mounted on said housing, a length indicator mounted on said housing, said length indicator having a sensing tip arranged to engage the tip of the sprayer needle of an injector valve held in said valve holder, direct electric current generating means contained within said housing, and circuit means for connecting said direct current generating means to the solenoid of the injector valve held in said valve holder, said circuit means including a normally opened contact, and a push button fitted on said housing and arranged to operate said normally opened contact.

* * * * *